US007481200B2

(12) United States Patent
Uplap et al.

(10) Patent No.: US 7,481,200 B2
(45) Date of Patent: Jan. 27, 2009

(54) START-UP CONTROL OF INTERNAL COMBUSTION ENGINES

(75) Inventors: Rahul R. Uplap, Pune Maharashtra (IN); Vinayak S. Tikhe, Pune Maharashtra (IN); Sunil S. Bahulikar, Pune Maharashtra (IN); Pralhad S. Despande, Pune Maharashtra (IN); Pravin A. Suryawanshi, Pune Maharashtra (IN); Asmita Y. Khairnar, Pune Maharashtra (IN); Manik S. Damle, Pune Maharashtra (IN); Ishani A. Pujari, Pune Maharashtra (IN)

(73) Assignee: Cummins Engine Company, Inc., Columbus, IN (US)

( * ) Notice: Subject to any disclaimer, the term of this patent is extended or adjusted under 35 U.S.C. 154(b) by 227 days.

(21) Appl. No.: 10/520,553

(22) PCT Filed: Jul. 3, 2003

(86) PCT No.: PCT/US03/21046

§ 371 (c)(1),
(2), (4) Date: Jul. 13, 2005

(87) PCT Pub. No.: WO2004/007938

PCT Pub. Date: Jan. 22, 2004

(65) Prior Publication Data

US 2006/0042590 A1 Mar. 2, 2006

Related U.S. Application Data

(60) Provisional application No. 60/395,649, filed on Jul. 12, 2002.

(51) Int. Cl.
*F02D 31/00* (2006.01)
*F02D 35/00* (2006.01)

(52) U.S. Cl. ..... 123/352; 290/40 A

(58) Field of Classification Search ..... 290/40 R, 290/40 C, 40 B, 40 A; 123/491, 352
See application file for complete search history.

(56) References Cited

U.S. PATENT DOCUMENTS 3,960,130 A * 6/1976 Peterson, Jr. ..... 123/179.18
4,114,570 A 9/1978 Marchak et al. ..... 123/32
4,205,641 A 6/1980 Yamasaki et al. ..... 123/179

(Continued)

FOREIGN PATENT DOCUMENTS

JP 57-206736 A2 12/1982

(Continued)

*Primary Examiner*—Julio Gonzalez
(74) *Attorney, Agent, or Firm*—Krieg DeVault LLP; J. Bruce Schelkopf; L. Scott Paynter

(57) ABSTRACT

An electric power generation system (20) is disclosed, which includes an electric power generator (22) driven by a four-cycle internal combustion engine (30). The engine (30) includes a plurality of reciprocating cylinders (C1-C6) each rotatably coupled to a crankshaft (34), which drives the electric power generator (22). A controller (90) is included that is operable to control fueling to start the engine (30) as a function of engine temperature and determine initial engine start-up as a function of rotational engine speed. This controller (90) regulates engine acceleration until a target engine speed is reached from initial start-up. Once this target speed is reached, the controller (90) provides a speed governor function.

19 Claims, 5 Drawing Sheets

U.S. PATENT DOCUMENTS

| | | | | | |
|---|---|---|---|---|---|
| 4,239,022 | A | | 12/1980 | Drews et al. | 123/491 |
| 4,444,173 | A | | 4/1984 | Yamato et al. | 123/491 |
| 4,463,730 | A | * | 8/1984 | Kishi | 123/491 |
| 4,481,928 | A | * | 11/1984 | Takimoto et al. | 123/492 |
| 4,572,132 | A | | 2/1986 | Piwonka | 123/357 |
| 4,593,663 | A | * | 6/1986 | Atago et al. | 123/339.12 |
| 4,625,123 | A | | 11/1986 | Gillett et al. | 290/40 B |
| 4,739,741 | A | | 4/1988 | Iwata et al. | 123/491 |
| 4,742,462 | A | * | 5/1988 | Fujimori et al. | 701/111 |
| 4,765,301 | A | | 8/1988 | Koike et al. | 123/491 |
| 4,852,011 | A | * | 7/1989 | Ueno | 701/110 |
| 4,911,132 | A | * | 3/1990 | Nakaniwa et al. | 123/492 |
| 4,964,386 | A | | 10/1990 | Akiyama et al. | 123/339 |
| 5,076,238 | A | | 12/1991 | Rosenau et al. | 123/491 |
| 5,199,400 | A | | 4/1993 | Sprenger et al. | 123/339 |
| 5,469,827 | A | | 11/1995 | Tomisawa | 123/491 |
| 5,890,467 | A | | 4/1999 | Romzek | 123/299 |
| 6,145,486 | A | | 11/2000 | Aikawa | 123/179.17 |
| 6,196,190 | B1 | | 3/2001 | Przymusinski et al. | 123/352 |
| 6,334,428 | B1 | | 1/2002 | Nagatani et al. | 123/305 |
| 6,467,458 | B1 | | 10/2002 | Suzuki et al. | 123/491 |
| 6,504,259 | B1 | * | 1/2003 | Kuroda et al. | 290/40 C |
| 2002/0011238 | A1 | | 1/2002 | Yomogida | 123/491 |
| 2002/0078922 | A1 | | 6/2002 | Mizuki | 123/352 |
| 2003/0019472 | A1 | | 1/2003 | Konno | 123/339.24 |
| 2003/0056763 | A1 | * | 3/2003 | Yomogida | 123/491 |

FOREIGN PATENT DOCUMENTS

| | | | |
|---|---|---|---|
| JP | 60-108547 | A2 | 6/1985 |
| JP | 62-93445 | A2 | 4/1987 |
| JP | 62-189338 | A2 | 8/1987 |
| JP | 63-106340 | A2 | 5/1988 |
| JP | 10-15443 | A2 | 1/1989 |
| JP | 8-28320 | A2 | 1/1996 |
| JP | 8-100692 | A2 | 4/1996 |
| JP | 9-151760 | A2 | 6/1997 |
| JP | 10-9016 | A2 | 1/1998 |
| WO | WO 01/34961 | A1 | 5/2001 |

* cited by examiner

START-UP CONTROL OF INTERNAL COMBUSTION ENGINES

CROSS-REFERENCE TO RELATED APPLICATIONS

The present application is the national stage of International Patent Application PCT/US03/21046, filed Jul. 3, 2003 (which was published in English), which claims the benefit of U.S. Provisional Application No. 60/395,649,filed Jul. 12, 2002, all of which are hereby incorporated by reference.

BACKGROUND

The present invention relates to internal combustion engines, and more particularly, but not exclusively, is directed to techniques to control start-up of a diesel-fueled, intermittent combustion type of engine driving an electrical power generator.

The ease with which an engine may be started frequently depends on a number of factors. By way of nonlimiting example, temperature is one such factor, with warm engines typically requiring less fuel to start than cold engines. Depending on the particular parameters involved, the amount of fuel used to start an engine can vary, which can impact the rate at which the engine accelerates to a target rotational engine speed. The amount of time it takes to reach this target engine speed from the initiation of engine start and/or the character of the attendant acceleration profile is often of particular interest in electrical power generation applications. Correspondingly, the fuel usage profile is frequently of interest—especially in the case of diesel-fueled engines for which the level of smoke generated upon start-up can vary significantly with fueling. Existing schemes typically attempt to reach a desired speed in a manner that does not adequately account for initial fueling fluctuation, often involves many different parameters, may significantly overshoot the target speed, and can result in excessive smoke production. Thus, there is a need for further contributions to this technology.

SUMMARY

One embodiment of the present invention is a unique internal combustion engine system. Other embodiments include unique methods, systems, apparatus, and devices to regulate engine operation.

A further embodiment includes providing fuel to start an internal combustion engine, determining the engine has started, controlling acceleration of the engine in response to this determination to reach a target engine speed, and driving an electric power generator with the engine at least while operating at the target engine speed. In one form, the engine includes a number of combustion chambers and corresponding reciprocating pistons, and the amount of fuel to start the engine is provided as a function of engine temperature. Alternatively or additionally, the initial start-up of the engine can be determined as a function of rotational engine speed and/or a speed governor may be utilized once the target engine speed is reached.

Another embodiment of the present invention includes a system, comprising: an internal combustion engine with a number of fuel injectors each operable to fuel a corresponding one of a number of combustion chambers, and a controller operatively coupled to the injectors to provide a desired amount of fuel to start the engine, detect initial engine start-up, and regulate engine acceleration from the initial engine start-up to a target engine speed. In one form, the engine operates as a prime mover for an electric power generator. Alternatively or additionally, an engine temperature sensor and engine rotation sensor can be included, with the engine temperature being utilized to determine the desired amount of fuel for starting the engine and the engine rotation sensor being utilized to determine when the engine has initially started and to regulate engine acceleration. The engine rotation sensor may further be utilized to provide speed governing of the engine once the target engine speed is reached.

In yet another embodiment of the present invention, an internal combustion engine includes a crank-shaft and a number of fuel injectors each operable to fuel a corresponding one of a number of combustion chambers. This embodiment further includes an electrical power generator, means for sensing engine temperature, means for sensing rotational engine speed, means for providing an amount of fuel to start the engine as a function of engine temperature, means for determining initial self-sustained operation of the engine as a function of the rotational engine speed, means for controlling engine acceleration from the initial operation to reach a target engine speed at a target time, and means for driving the electric power generator with the engine system.

Accordingly, it is one object of the present invention to provide a unique internal combustion engine system.

Another object of the present invention is to provide a unique method, system, apparatus, or device to regulate engine operation.

Further embodiments, forms, features, objects, advantages, benefits, and aspects of the present invention shall become apparent from the detailed description and drawings provided herewith.

DETAILED DESCRIPTION OF SELECTED EMBODIMENTS

Figure 1:
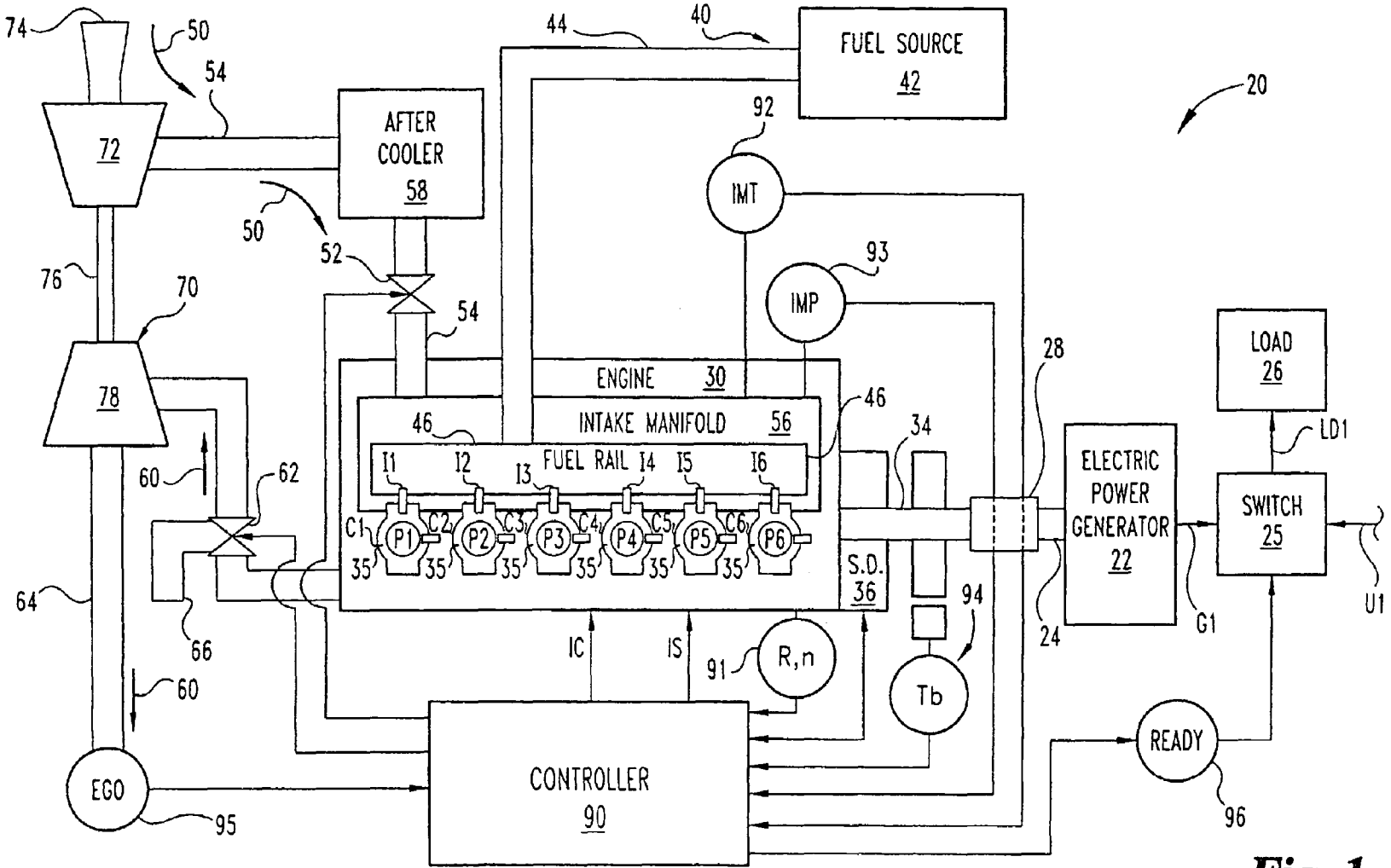
FIG. 1 is a schematic view of a first embodiment of an electric power generation system.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

FIG. 1 depicts electric power generation system 20 of one embodiment of the present invention. System 20 includes electric power generator 22. Preferably, generator 22 is of a conventional electromagnetic type which converts the input mechanical energy from rotation of shaft 24 into a generally sinusoidal Alternating Current (A.C.) electric output on generator bus G1. Generator bus G1 is input to power routing switch 25. Similarly, utility power bus U1 is input to switch 25. Switch 25 is configured to select between buses G1 and U1 as a source of power for bus LD1. Bus LD1 is operatively coupled to load 26 to supply electric power thereto. Generator 22 may be configured for single phase or multiphase operation, as appropriate for load 26. Also, an electric power output other than a sinusoidal waveform or A.C. type may be utilized as would occur to those skilled in the art.

System 20 also includes engine 30. Engine 30 is a prime mover for generator 22. Engine 30 is of a reciprocating piston variety. Shaft 24 of generator 22 is coupled to engine 30 by shaft coupling 28. Shaft coupling 28 may include a gear box, clutch, or other mechanical arrangement to suitably couple crankshaft 34 of engine 30 to shaft 24 of generator 22. In one embodiment, coupling 28 includes a clutch to selectively couple and decouple shafts 24 and 34. Additionally, coupling 28 may include intermeshing gears to change the rotational speed of shaft 24 relative to shaft 34 and may also include a number of selectable gears to change the gear ratio. In still other embodiments, shaft 34 and shaft 24 may be directly coupled to provide a one-to-one turning ratio.

In addition to crankshaft 34, engine 30 includes a number of cylinders C1-C6 each having a corresponding reciprocating piston P1-P6 that is rotatably coupled to crankshaft 34 by a connecting rod in a conventional manner. Each pair of cylinders C1-C6 and pistons P1-P6 in turn corresponds to one of a respective number of combustion chambers 35 of engine 30. Engine 30 also includes fuel injectors I1-I6 each shown in fluid communication with one of chambers 35.

System 20 further includes engine starting device (S.D.) 36 coupled to engine 30. Starting device 36 may be of a conventional starter motor powered by a battery. In other embodiments, starting device 36 can be of a different type or may be absent, with engine start-up assistance being provided in a different manner.

System 20 also includes fueling subsystem 40. Subsystem 40 includes fuel source 42 operatively coupled to fueling conduit 44. Fueling conduit 44 is in fluid communication with fuel rail 46. Fuel injectors I1-I6 receive fuel from fuel rail 46 to selectively inject fuel into each cylinder C1-C6. Fueling with injectors I1-I6 may be by port injection, direct injection, or using such other injection techniques as would occur to those skilled in the art. Preferably, fuel injectors I1-I6 are of a conventional electromagnetic variety responsive to an input electronic signal IS1-IS6 (collectively designated signals IS). Engine 30 is of the multicycle type with intermittent combustion in each cylinder C1-C6 intermittently contributing power in accordance with a timed sequence of fueling and ignition operations. Engine 30 is of a conventional four-stroke, reciprocating piston variety. However, in lieu of a reciprocating piston-based engine, a rotor-based engine may be utilized in an alternative embodiment of the present invention. Also, in other embodiments, an engine with a different number of operating cycles, such as a two-cycle sequence, may be utilized. Engine 30 is configured to operate with a diesel fuel supplied from fuel source 42 that is injected with injectors I1-I6, and is of the Compression Ignition (CI) variety. As such, it may include glow plugs (not shown) to control combustion temperature. Alternatively, engine 30 could be configured for other fuel types used such as gasoline, alcohol, a gaseous fuel (a "gaseous fuel" refers to a fuel which is in the gaseous state when contained at standard temperature and pressure), a different fuel as would occur to those skilled in the art, or a combination of these; and correspondingly be of a different ignition type, such as a Spark Ignition (SI) variety.

Air is supplied to cylinders C1-C6 via air intake path 50. Air intake path 50 includes throttle valve 52 positioned therealong to control air flow through conduit 54 to intake manifold 56. Air from intake manifold 56 is mixed with fuel from injectors I1-I6 to selectively provide a combustible charge in each of cylinders C1-C6. Engine 30 also includes exhaust pathway 60. Exhaust from engine 30 exits along pathway 60 through conduit 64. A controllable wastegate valve 62 is included to selectively vent exhaust gases through wastegate outlet 66.

The intake air pathway 50 and exhaust pathway 60 include components of turbocharger 70. Turbocharger 70 includes compressor 72 which draws air through inlet 74 into conduit 54 of pathway 50. The intake air pressurized by compressor 72 is cooled by aftercooler 58 before passing through throttle valve 52. Throttle valve 52 and aftercooler 58 may be of conventional variety commonly used in internal combustion engines. Compressor 72 is driven by turbine 78 via coupling 76. Coupling 76 may include a rotatable shaft, pulley and belt arrangement, intermeshing gears, or such other arrangement to drive compressor 72 with turbine 78 as would occur to those skilled in the art. In still other embodiments, multistage compressors, multistage turbines, variable geometry turbines and/or compressors, or a combination of these are envisioned. In yet another embodiment, turbocharger 70 is absent.

Turbine 78 is driven by exhaust gasses passing through conduit 64 along exhaust pathway 60. To control the pressure and flow rate through pathways 60 and 50, wastegate valve 62 may be selectively opened in response to a control signal WG. By reducing the flow of exhaust gasses to turbine 78, the rotation of both compressor 72 and turbine 78 typically decreases. As a result, the pressure of air supplied along pathway 50 also decreases. Also, the rotation of turbine 78 varies with temperature of the exhaust gases driving it.

System 20 further includes controller 90. Preferably, controller 90 is of a programmable microprocessor variety known to those skilled in the art. Controller 90 is operatively coupled to throttle valve 52 and wastegate 62 supplying corresponding adjustment signals TLT, WG; respectively, as required. Controller 90 is also coupled to rotation sensor 91 which is configured to supply signal R indicative of rotation of shaft 34. Preferably, signal R provides conventional crank angle information about engine 30 which may be utilized for timing operation of engine 30. Rotational engine speed, designated as signal n, is determined from signal R in a conventional manner. In one embodiment, signal R corresponds to a pulse train, the frequency of which is directly proportional to the rotational speed of engine 30. Signal n may then be provided by monitoring the pulse train frequency. U.S. Pat. No. 5,165,271 to Stepper et al.; U.S. Pat. No. 5,460,134 to Ott et al.; and U.S. Pat. No. 5,469,823 to Ott et al. are representative of an arrangement suitable for providing signals R and n. Controller 90 is further coupled to starting device 36 to regulate operation thereof.

Controller 90 is also coupled to temperature sensor 92 to provide engine temperature as signal ET. Controller 90 is operatively coupled to pressure sensor 93 to provide intake manifold pressure signal IMP. Controller 90 is also operatively coupled to torque sensor 94. Sensor 94 is associated with a flywheel along shaft 34 to determine brake torque or "shaft torque" of engine 30 which is designated as signal Tb. Controller 90 is operatively coupled to an exhaust gas oxygen sensor 95 to monitor oxygen content of the exhaust stream exiting conduit 84. Signal EGO corresponds to the detected oxygen level in the exhaust stream. Controller 90 is also configured to generate a signal READY which is provided to an indicator 96 to indicate that engine 30 is ready to accept block loading from generator 22. Signal READY is sent to switch 25 to control operation thereof.

Figure 2:
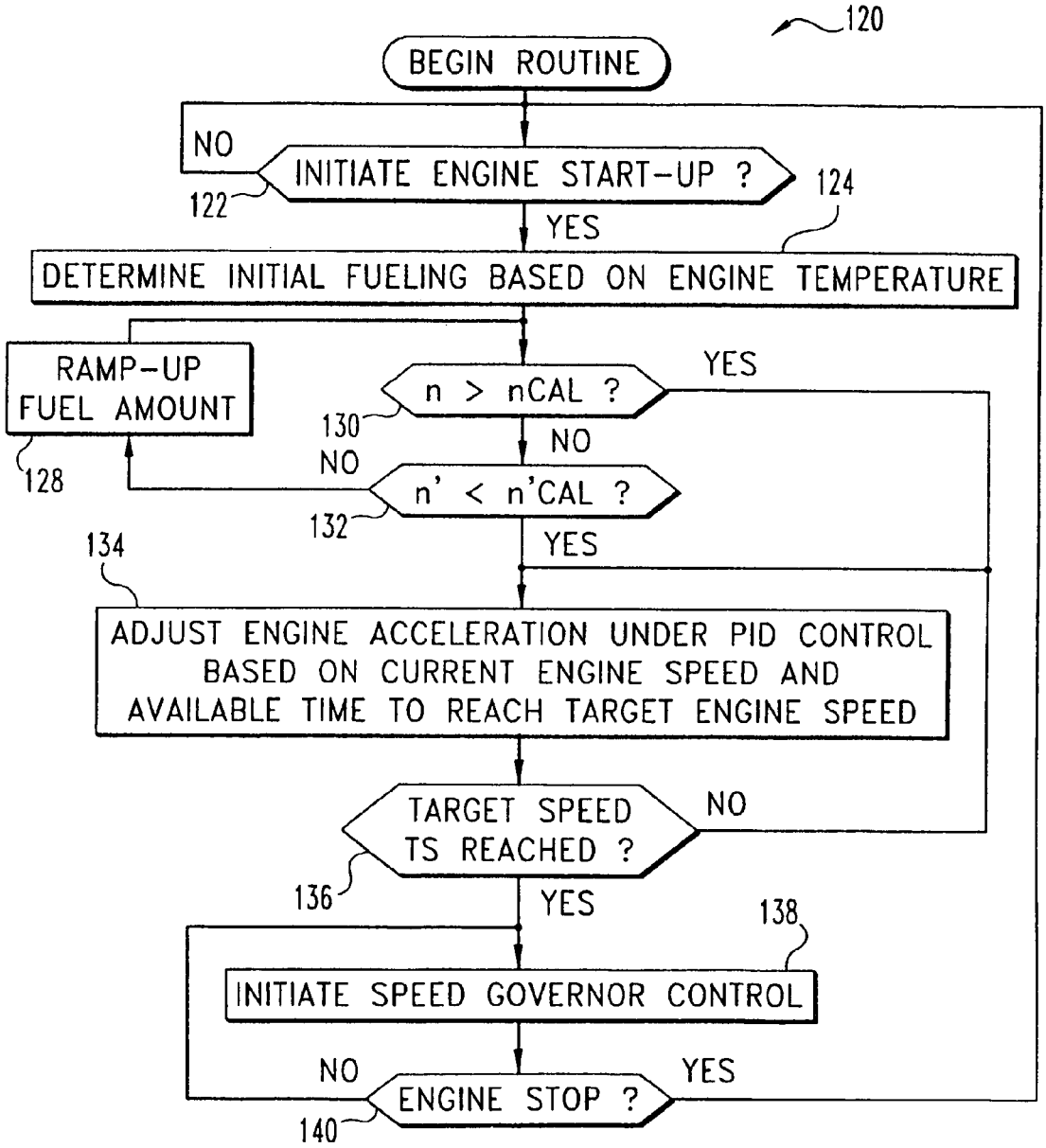
FIG. 2 is a flowchart of a routine for start-up of the engine shown in FIG. 1.

FIG. 2 is a flow chart of start-up routine 120 for system 20 that is executed in accordance with programming or other logic of controller 90. Start-up routine 120 begins with conditional 122 which tests whether or not to initiate engine start-up. If so, routine 120 proceeds to operation 124. In operation 124, an initial fueling amount to be provided to the engine is determined based on engine temperature. In the case of engine 30, this fueling amount can be determined in accordance with temperature detected with engine temperature sensor 92. A schedule, table, and/or mathematical function can be used by controller 90 to determine initial start-up fueling for engine 30, and generate corresponding fueling signals for injectors I1-I6. Likewise, controller 90 can activate starting device 36 to crank engine 30 during supply of the initial fuel amount, as part of operation 124. Typically, when the engine is relatively warm, a minimal amount of fuel is needed and the engine fires quickly with little or no fuel accumulation. On the other hand, in the case of a relatively cold engine, excess fuel sometimes accumulates in the combustion chambers before the engine fires. As this excess fuel burns, there can be a sudden increase in engine acceleration.

Once cranking of the engine with this initial amount of fuel begins, routine 120 proceeds to a series of conditionals 130 and 132 to determine if the engine has attained an initial operating state. This operating state can be reflective of initial self-sustained operation—such that assistance by starting device 36 is no longer needed. Conditional 130 tests if the engine speed n is greater than threshold nCAL (n>nCAL). If the test of conditional 130 is affirmative, routine continues with operation 134. If the test of conditional 130 is negative, routine 120 continues with conditional 132, which tests if the rotational engine acceleration n' is greater than threshold n'CAL (n'>n'CAL). If the test of conditional 132 is also negative, operation 128 is next encountered in which the amount of fuel supplied to the engine is increased by a predetermined increment up to a maximum value. With this ramped-up amount, the test of conditional 130 is again performed which, if negative, results in performing the test of conditional 132. If both conditional 130 and 132 remain negative again, operation 128 is again encountered to provide a further increment in the fueling. In this manner as long as the tests of both conditionals 130 and 132 are negative, operation 128 is repeated, gradually increasing the amount of fuel supplied to the engine up to a predefined limit. In contrast, if the test of either of conditionals 130 or 132 is affirmative, routine 120 continues with operation 134 and cranking assistance with starting device 36 is no longer needed.

Conditionals 130 and 132, and operation 128 cooperate to detect if the initial operating state of the engine has been attained. The engine speed n for conditional 130 can be determined with rotation sensor 91, and engine acceleration n' for conditional 132 can be determined from engine speed n. Comparisons to thresholds nCAL and n'CAL can be performed with logic of controller 90. In one embodiment, thresholds nCAL and n'CAL are calibration parameters stored in memory accessed by controller 90. The incremental fueling can be determined by controller logic by accessing a schedule, table, corresponding mathematical function, or the like; and implemented by sending appropriate fueling signals to the fuel injectors.

Figure 3:
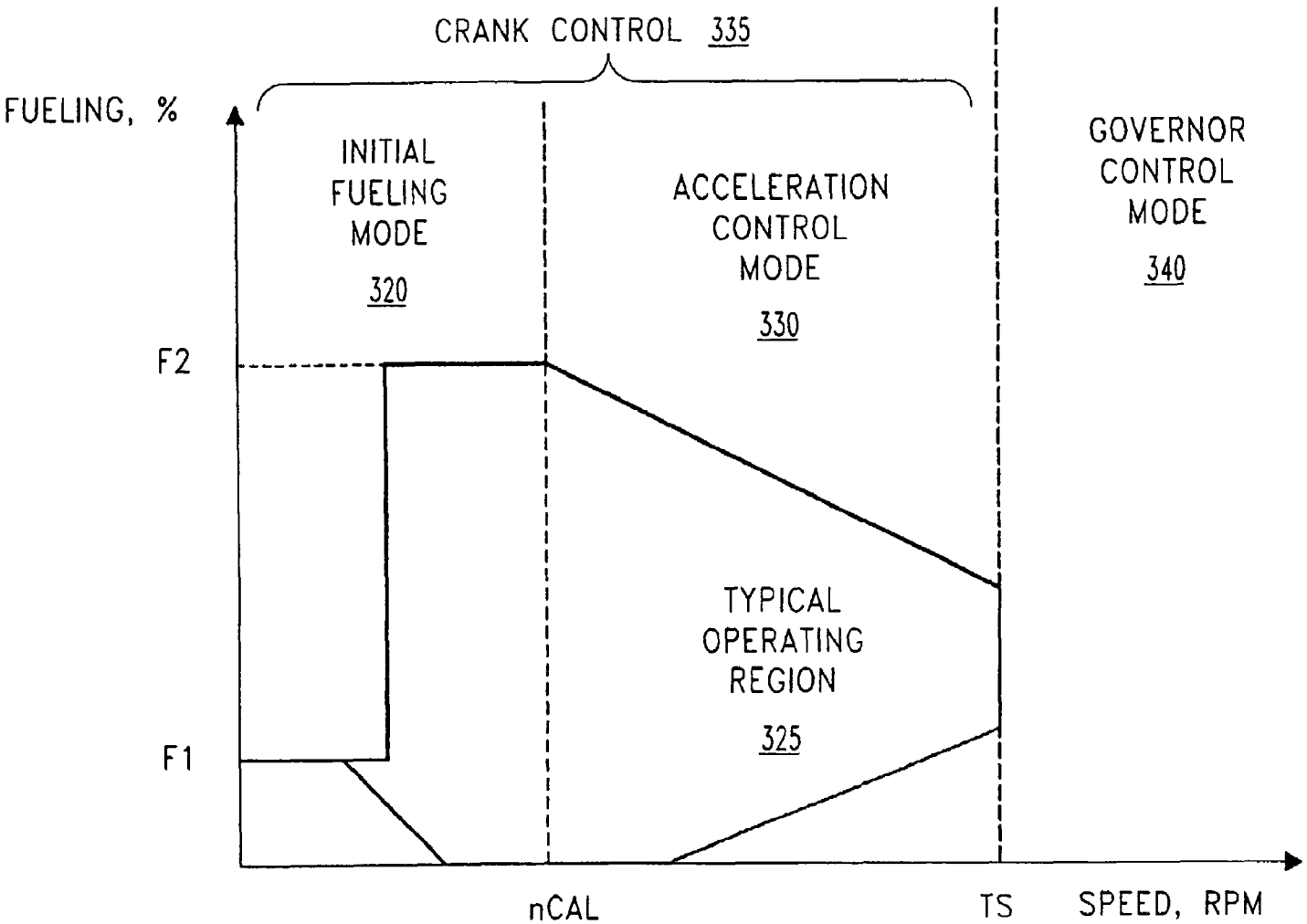
FIG. 3 is a graph of engine fueling versus rotational engine speed corresponding to the routine of FIG. 2.

Referring additionally to FIG. 3, conditionals and operations 124-132 correspond to an initial fueling mode 320 of engine 30. As routine proceeds from conditional 130 or 132 to operation 134, initial fueling mode 320 is exited and an acceleration control mode 330 is initiated. Both modes 320 and 330 are shown in FIG. 3 under crank control 335.

In operation 134 of mode 330, engine acceleration is determined with a Proportional Integral Derivative (PID) control based on the current engine speed n and available time to reach a target rotational engine speed TS. In other words, engine acceleration n' determined from engine speed n becomes a closed-loop feedback variable for PID compensation, where the target acceleration necessary to reach a target rotational engine speed TS is calculated based on a target time interval TT. Target time interval TT typically begins with engine start-up initiation. Operation 134 of mode 330 is initiated at time t1, which represents the varying time interval during which the initial fueling mode 320 of routine 120 was performed. From the initiation of operation 134, the available performance time PT to reach target rotational engine speed TS is also variable, being the target time interval TT less t1 (PT=TT−t1). Accordingly, a target acceleration from time t1 to provide TS by time TT could be the engine speed difference obtained by subtracting the engine speed when mode 330 begins (ES) from TS divided by PT ((TS−ES)/PT).

Conditional 136 of routine 120 represents the corresponding comparison to determine if the target engine rotational speed TS has been reached. If the test of conditional 136 is negative, routine 120 returns to continue operation 134. If the test of conditional 136 is positive, routine 120 continues with operation 138 in which a third mode corresponding to an engine speed governor control mode 340 is initiated. The PID control of operation 134 and corresponding comparison of conditional 136 can be implemented in part or in total with logic executed by controller 90. Typically, controller 90 is configured to activate switch 25 such that it begins to transmit power from generator 22 once the target speed TS is reached with the engine being subject to engine speed governor control mode 340. This speed governing can also be executed with logic of controller 90.

Referring specifically to FIG. 3, the irregular polygon-shaped region 325 represents the typical operating ranges of fueling and engine speed for one embodiment. It should be further understood that fueling percentage F1 is the initial fueling percentage used by operation 124 of routine 120. If this percentage ramps up through execution of operation 128, it is incrementally increased towards the fueling percentage limit F2 shown in FIG. 3. F2 serves as the maximum fuel amount during the operation of initial fueling mode 320. As further shown in FIG. 3, nCAL corresponds to the value used in the test of conditional 130 and TS corresponds to the target speed tested with conditional 136. Between the values of nCAL and TS is the range in which the acceleration control mode 330 operates. It should be appreciated that initial fueling mode 320 and acceleration control mode 330 are both components of a crank control 335 which corresponds to conditionals and operations 122-136 of routine 120. Speed governor control mode 340 operates once the target speed TS is reached as presented in the graph of FIG. 3.

Figure 4:
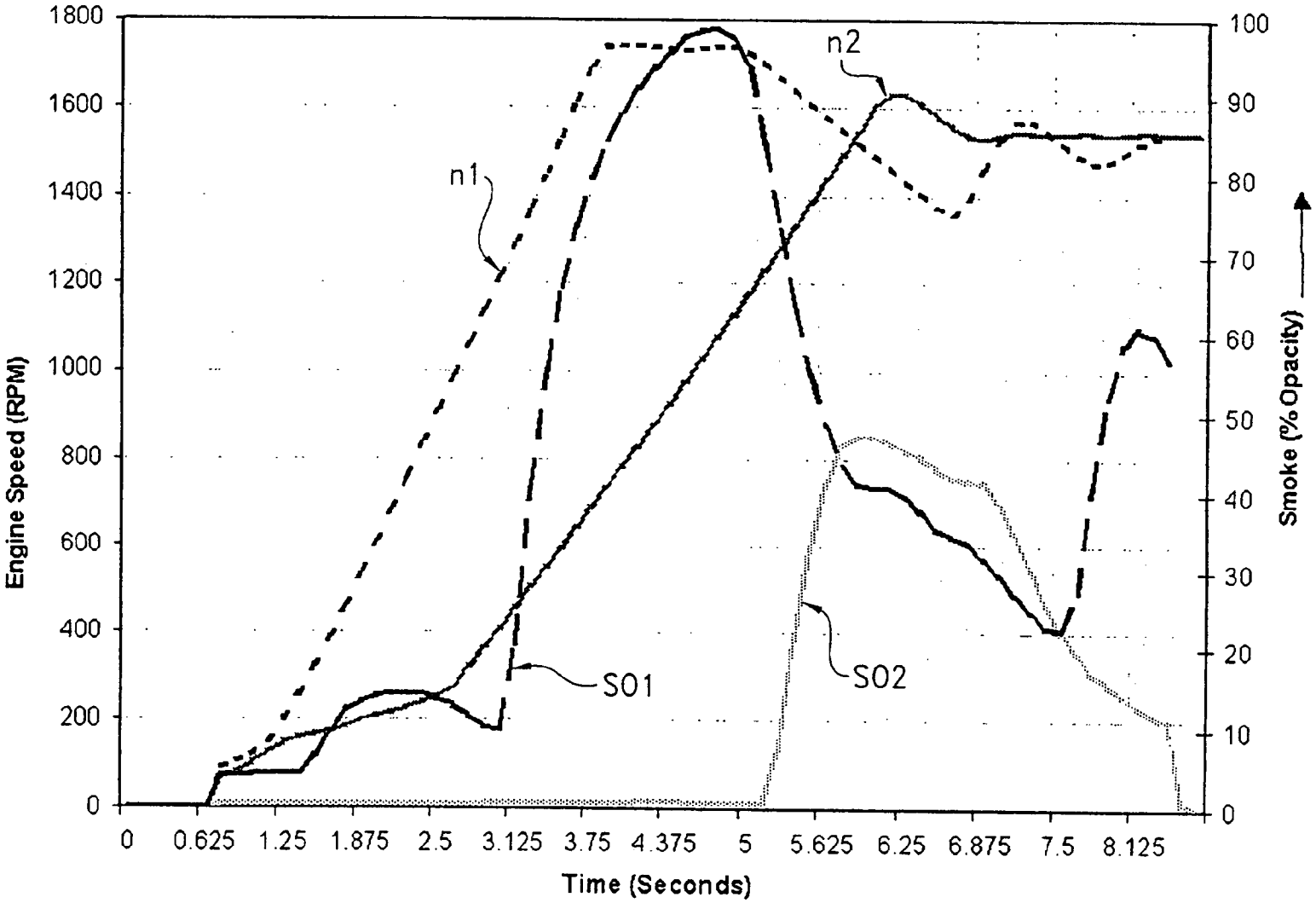
FIG. 4 is a graph illustrating engine start-up acceleration and smoke generation for the routine of FIG. 2 compared to another arrangement.

FIG. 4 is a comparative graph of speed and smoke opacity curves. Specifically, n1 and S01 correspond to a speed versus time curve and a smoke opacity versus time curve for a standard type of diesel engine start-up. In contrast, n2 and S02 correspond to a speed versus time curve and a smoke opacity versus time curve for an engine operated in accordance with routine 120. Notably, curve n2 reaches a steady state target time of about five seconds with less variation, ringing, and overshoot than speed curve n1. Likewise, the degree of smoke indicated by smoke opacity curve S02 is substantially less than that of smoke opacity curve S01.

Controller 90 may be comprised of digital circuitry, analog circuitry, or both. Also, controller 90 may be programmable, a dedicated state machine, or a hybrid combination of programmable and dedicated hardware. Controller 90 can be an electronic circuit comprised of one or more components that are assembled as a common unit. Alternatively, for a multiple component embodiment, one or more of these components may be distributed throughout the relevant system. In one embodiment, controller 90 includes an integrated processing unit operatively coupled to one or more solid-state memory devices that contains programming to be executed by the processing unit in accordance with the principals of the present invention. The memory may be either volatile or nonvolatile and may additionally or alternatively be of the magnetic, optical, or such other variety as would occur to one skilled in the art. Besides the memory and processing unit, controller 90 can include any control clocks, interfaces, signal conditioners, filters, Analog-to-Digital (A/D) converters, Digital-to-Analog (D/A) converters, communication ports, or other types of operators as would occur to those skilled in the art to implement the principles of the present invention. In a further form, an integrated circuit processing unit of controller 90 may be provided with corresponding memory and any associated circuitry as part of a control panel coupled to engine 30. For this form, the panel can include a key-switch for operator activation/deactivation of system 20. Alternatively or additionally, this panel can include one or more hardwired and/or wireless connections to one or more remote control devices to start, stop, or adjust engine parameters such as target engine speed. Sensors of the present invention may provide a signal in either a digital or analog format compatible with associated equipment. Correspondingly, equipment coupled to each sensor is configured to condition and convert sensor signals to the appropriate format, as required.

As further described in connection with FIGS. 3 and 4, routine 120 of FIG. 2 provides a procedure to reach a target rotational engine speed within a target time range via mode 330 even though initial fueling may vary considerably during mode 320. Moreover, the level of smoke generated is typically reduced through this procedure compared to a generalized procedure that ramps to a target rotational engine speed through an open-loop process without control over acceleration, with fewer parameters to tune and less risk of overshoot. Unlike other arrangements, mode 330 utilizes all the available time to reach the target speed. Accordingly, in the case of a quick-start, the relatively greater amount of time to reach rated speed can be used to strive for smoke reduction—such as by reducing acceleration. Alternatively, when a greater amount of time is used during mode 320, a greater acceleration is used during mode 330, at the possible sacrifice of greater smoke production, to assure target speed within the target time. Naturally, in other embodiments, smoke level, target speed, and/or target time to reach target speed can be prioritized differently; and/or one or more may not be of concern.

Figure 5:
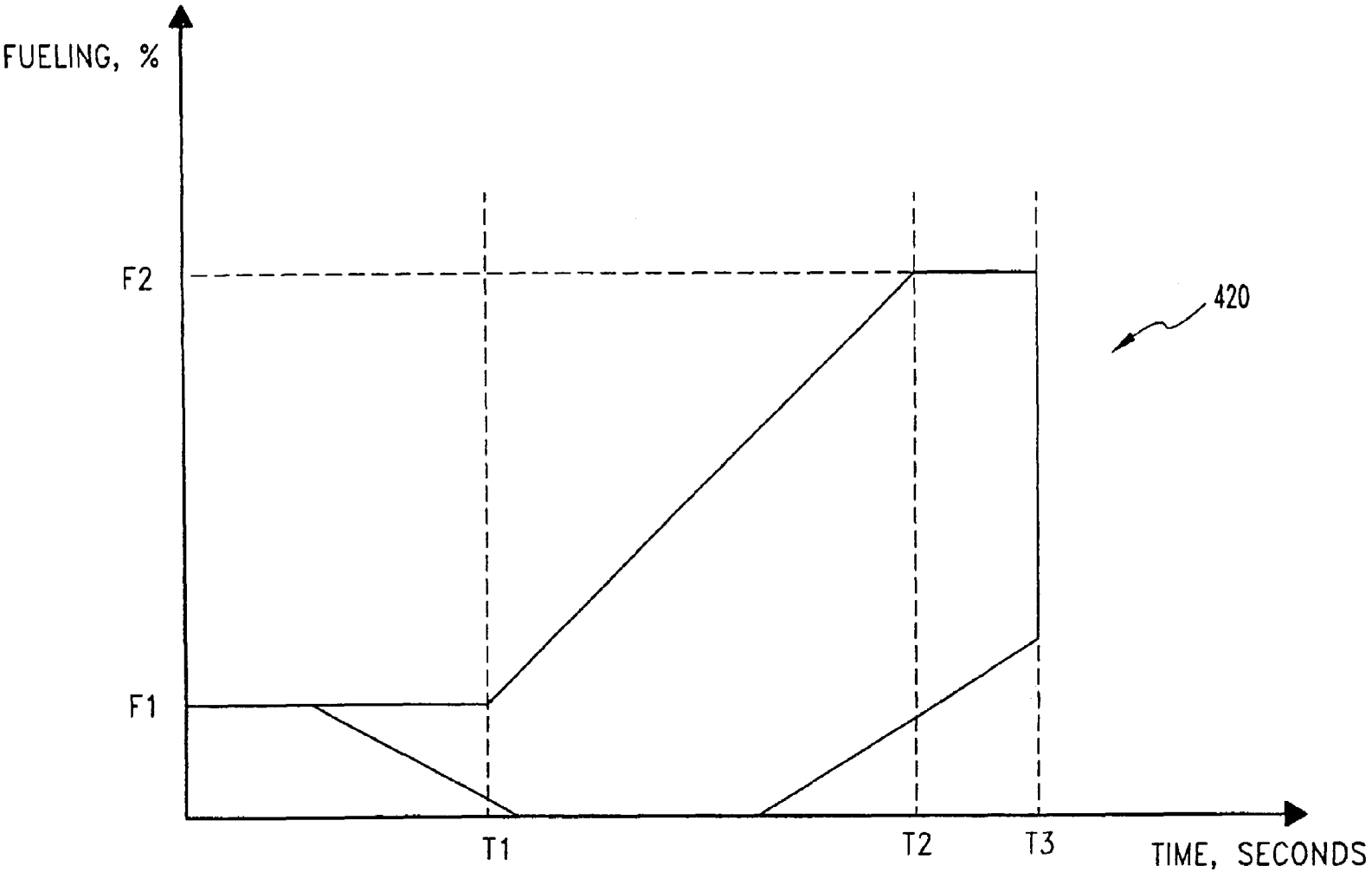
FIG. 5 is a graph of engine fueling versus time of a further embodiment of a routine for start-up of the engine as shown in FIG. 1.

FIG. 5 is a graph of engine fueling versus time depicting a further embodiment of an initial fueling mode 420 that can be implemented instead of mode 320 during execution of routine 120. For mode 420, engine fueling begins at an initial fueling percentage F1. At time T1, a transition from F1 to F2 is initiated to transfer from an initial fueling state to an acceleration control state in accordance with the indicated envelope. At time T2, this transition is complete, and mode 420 terminates with an initial fueling exit envelope corresponding to the duration from time T2 to T3.

In other embodiments, engine 30, controller 90, and routine 120 (or corresponding variations thereof) can be used to drive a device different than generator 22. For example, a pump or other machine where a generally constant rotational speed of a driving member is desired. In another example, off-road vehicles, such as earth-moving equipment, may be configured to utilize routine 120. Other forms of the present invention can include an engine that uses carburetion fueling with or without injection fueling. Alternatively or additionally, a non-diesel fuel could be used and/or a different ignition type, such as the SI variety.

As used herein, it should be appreciated that: variable, criterion, characteristic, quantity, amount, value, constant, flag, data, record, threshold, limit, input, output, matrix, command, and look-up table, each generally correspond to one or more signals within processing equipment of the present invention. It is contemplated that various functional blocks, operators, operations, stages, conditionals, procedures, thresholds, and processes described in connection with the present invention could be altered, rearranged, substituted, deleted, duplicated, combined, or added as would occur to those skilled in the art without departing from the spirit of the present invention.

All publications, patent, and patent applications cited in this specification are herein incorporated by reference as if each individual publication, patent, or patent application were specifically and individually indicated to be incorporated by reference and set forth in its entirety herein, including, but not limited to, U.S. Pat. No. 6,408,625 B1 to Woon; U.S. Pat. No. 5,949,146 to Vandenberghe; U.S. Pat. No. 5,904,131 to O'Neill; and U.S. Pat. No. 5,713,340 to Vandenberghe. Any theory of operation or finding described herein is merely intended to provide a better understanding of the present invention and should not be construed to limit the scope of the present invention as defined by the claims that follow to any stated theory or finding. While the invention has been illustrated and described in detail in the drawings and foregoing description, the same is to be considered as illustrative and not restrictive in character, it being understood that only the preferred embodiment has been shown and described and that all changes, modifications, and equivalents that come within the spirit of the invention as defined by the following claims are desired to be protected.

What is claimed is:

1. A method of generating electric power, comprising:

providing an amount of fuel to start an internal combustion engine as a function of engine temperature, the engine including a number of combustion chambers and corresponding reciprocating pistons;

determining initial operation of the engine as a function of rotational engine speed in response to said providing;

controlling engine acceleration from the initial operation to reach the target engine speed at a target time, wherein the controlling engine acceleration comprises reducing fuel provided to the engine before the target engine speed is reached to reduce smoke output by the engine; and driving an electric power generator with the engine.

2. The method of claim 1, which includes governing speed of the engine after reaching the target engine speed.

3. The method of claim 1, wherein the fuel is of a diesel type.

4. The method of claim 1, wherein said controlling includes calculating the engine acceleration from engine rotational speed and a time period determined relative to the initial operation of the engine.

5. The method of claim 1, wherein said controlling includes regulating fuel supplied to the engine to provide the engine acceleration calculated to provide the target speed at the target time.

6. The method of claim 1, wherein said determining includes detecting performance of the engine at or above at least one of an engine speed threshold and an engine acceleration threshold.

7. The method of claim 1, wherein the providing of the amount of fuel includes fueling the engine with a number of fuel injectors.

8. The method of claim 1, wherein the engine includes a turbocharger.

9. A method of generating electric power, comprising:

providing an amount of fuel to start an internal combustion engine as a function of engine temperature, the engine including a number of combustion chambers and corresponding reciprocating pistons;

determining initial operation of the engine as a function of rotational engine speed in response to said providing;

controlling engine acceleration from the initial operation to reach the target engine speed at a target time;

driving an electric power generator with the engine;

providing electric power from the generator to a first input of a routing switch;

providing a utility power bus input to a second input of the routing switch; and with the routing switch, selecting between the generator and the utility power bus to power an electric load bus.

10. A method of generating electric power, comprising:

providing an amount of fuel to start an internal combustion engine as a function of engine temperature, the engine including a number of combustion chambers and corresponding reciprocating pistons;

determining initial operation of the engine as a function of rotational engine speed in response to said providing;

controlling engine acceleration from the initial operation to reach a target engine speed at a target time, wherein said controlling includes regulating fuel supplied to the engine to provide the engine acceleration calculated to provide the target speed at the target time; and driving an electric power generator with the engine, wherein said regulating includes reducing the fuel if the amount of fuel provided to start the engine exceeds a desired quantity.

11. The method of claim 10, wherein said controlling includes calculating the engine acceleration from engine rotational speed and a time period determined relative to the initial operation of the engine.

12. The method of claim 10, wherein said determining includes detecting performance of the engine at or above at least one of an engine speed threshold and an engine acceleration threshold.

13. The method of claim 10, wherein the fuel is of a diesel type and the controlling engine acceleration comprises reducing fuel provided to the engine before the target engine speed is reached to reduce smoke output by the engine.

14. The method of claim 10, wherein the engine includes a turbocharger.

15. The method of claim 10, which includes:

providing the electric power from the generator to a first input of a routing switch;

providing a utility power bus input to a second input of the routing switch; and with the routing switch, selecting between the generator and the utility power bus to power an electric load bus.

16. A method of generating electric power, comprising:

providing an amount of fuel to start an internal combustion engine as a function of engine temperature, the engine including a number of combustion chambers and corresponding reciprocating pistons;

determining initial operation of the engine as a function of rotational engine speed in response to said providing;

controlling engine acceleration from the initial operation to reach a target engine speed at a target time, which includes reducing fuel supplied to the engine if the amount of fuel provided to start the engine exceeds a desired quantity; and driving an electric power generator with the engine.

17. The method of claim 16, wherein the engine includes a turbocharger.

18. The method of claim 16, which includes:

providing the electric power from the generator to a first input of a routing switch;

providing a utility power bus input to a second input of the routing switch; and with the routing switch, selecting between the generator and the utility power bus to power an electric load bus.

19. The method of claim 16, wherein the fuel is of a diesel type and the controlling engine acceleration comprises reducing fuel provided to the engine before the target engine speed is reached to reduce smoke output by the engine.

* * * * *